US008727907B2

(12) United States Patent
Ban et al.

(10) Patent No.: US 8,727,907 B2
(45) Date of Patent: May 20, 2014

(54) METHOD OF MANUFACTURING GOLF CLUB HEAD, GOLF CLUB HEAD, AND HEAD BASE BODY

(75) Inventors: Wataru Ban, Chichibu (JP); Katsutoshi Kasuya, Asaka (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 619 days.

(21) Appl. No.: 12/967,521

(22) Filed: Dec. 14, 2010

(65) Prior Publication Data

US 2011/0152002 A1 Jun. 23, 2011

(30) Foreign Application Priority Data

Dec. 21, 2009 (JP) ..... 2009-289180

(51) Int. Cl.
*A63B 53/04* (2006.01)
*B22D 31/00* (2006.01)
*B23P 13/04* (2006.01)

(52) U.S. Cl.
USPC ..... 473/324; 473/331; 473/349; 473/350; 473/409; 29/527.6; 29/557

(58) Field of Classification Search
USPC ..... 473/324–350, 287–292, 409; 29/527.6, 29/557
See application file for complete search history.

(56) References Cited

U.S. PATENT DOCUMENTS

| | | | | | |
|---|---|---|---|---|---|
| 4,472,092 | A | * | 9/1984 | Schmidt | 164/35 |
| 4,558,505 | A | * | 12/1985 | Moore | 29/527.6 |
| 4,577,669 | A | * | 3/1986 | Schmidt et al. | 164/45 |
| 4,651,799 | A | * | 3/1987 | Chandley | 164/35 |
| 5,261,478 | A | * | 11/1993 | Sun | 164/137 |
| 5,346,218 | A | * | 9/1994 | Wyte | 473/346 |
| 5,527,034 | A | | 6/1996 | Ashcraft et al. | |
| 5,538,798 | A | * | 7/1996 | Sheehan | 428/577 |
| 5,595,234 | A | * | 1/1997 | Beck | 164/9 |

(Continued)

FOREIGN PATENT DOCUMENTS

| | | | |
|---|---|---|---|
| JP | 7-148287 | A | 6/1995 |
| JP | 9-192268 | A | 7/1997 |

(Continued)

OTHER PUBLICATIONS

Japanese Office Action, dated Aug. 20, 2013, issued in corresponding Japanese Patent Application No. 2009-289180.

*Primary Examiner* — Sebastiano Passaniti
(74) *Attorney, Agent, or Firm* — Sughrue Mion, PLLC

(57) ABSTRACT

This invention provides a method of manufacturing a golf club head by processing a head base body having a face base surface which becomes a face surface by finishing. The head base body includes a main body portion having the face base surface, and projecting portions which project from the main body portion. The method includes a finishing step of performing the finishing while the head base body is fixed in position by supporting the projecting portions, and a separation step of separating the projecting portions after the finishing.

15 Claims, 3 Drawing Sheets

(56) References Cited

U.S. PATENT DOCUMENTS

| | | | | |
|---|---|---|---|---|
| 5,651,408 | A * | 7/1997 | Sheehan | 164/235 |
| 5,651,409 | A * | 7/1997 | Sheehan | 164/412 |
| 5,753,170 | A * | 5/1998 | Muang | 264/275 |
| 6,739,376 | B1 * | 5/2004 | Cheng et al. | 164/35 |
| 6,813,821 | B1 * | 11/2004 | Tseng | 29/527.6 |
| 7,491,136 | B2 * | 2/2009 | Deng et al. | 473/349 |
| 7,905,798 | B2 * | 3/2011 | Petersen et al. | 473/331 |
| 2003/0017886 | A1 | 1/2003 | Takeda | |
| 2004/0083596 | A1 * | 5/2004 | Willett et al. | 29/557 |
| 2008/0020859 | A1 | 1/2008 | Yamagishi et al. | |
| 2009/0029797 | A1 * | 1/2009 | Ban et al. | 473/331 |

FOREIGN PATENT DOCUMENTS

| | | | |
|---|---|---|---|
| JP | 2003-33454 | A | 2/2003 |
| JP | 2008-23178 | A | 2/2008 |
| JP | 2008-23552 | A | 2/2008 |
| JP | 2009-66312 | A | 4/2009 |

* cited by examiner

METHOD OF MANUFACTURING GOLF CLUB HEAD, GOLF CLUB HEAD, AND HEAD BASE BODY

BACKGROUND OF THE INVENTION

1. Field of the Invention

The present invention relates to a method of manufacturing a golf club head, a golf club head, and a head base body.

2. Description of the Related Art

Japanese Patent Laid-Open No. 9-192268 describes a method of mounting a shaft into the hosel of an iron head by clamping the head body by pressing a clamping member, having a flexible material attached to its distal end, against the outer peripheral edge of the head body using a hydraulic cylinder or an air cylinder.

Upon processes such as grinding, milling, and scoreline formation by cutting for the surface of a head base body, a considerable force acts on the head base body. Hence, as in the method described in Japanese Patent Laid-Open No. 9-192268, when the head base body is held/fixed in position by pressing the flexible material against the outer peripheral edge of the head base body, it oscillates upon these processes and therefore cannot be processed with high accuracy.

SUMMARY OF THE INVENTION

It is an object of the present invention to finish a head base body with high accuracy while it is tightly held/fixed in position.

According to an aspect of the present invention, there is provided a method of manufacturing a golf club head by processing a head base body having a face base surface which becomes a face surface by finishing, wherein the head base body includes a main body portion having the face base surface, and projecting portions which project from the main body portion, and the method comprises a finishing step of performing the finishing while the head base body is fixed in position by supporting the projecting portions, and a separation step of separating the projecting portions after the finishing.

According to another aspect of the present invention, there is provided a golf club head of one of an iron type and a putter type manufactured by the method.

According to still another aspect of the present invention, there is provided a golf club head base body having a face base surface which becomes a face surface by finishing, comprising a main body portion having the face base surface, and projecting portions which project from the main body portion and are supported by a finishing device in the finishing.

Further features of the present invention will become apparent from the following description of exemplary embodiments with reference to the attached drawings.

DESCRIPTION OF THE EMBODIMENTS

Figure 1:
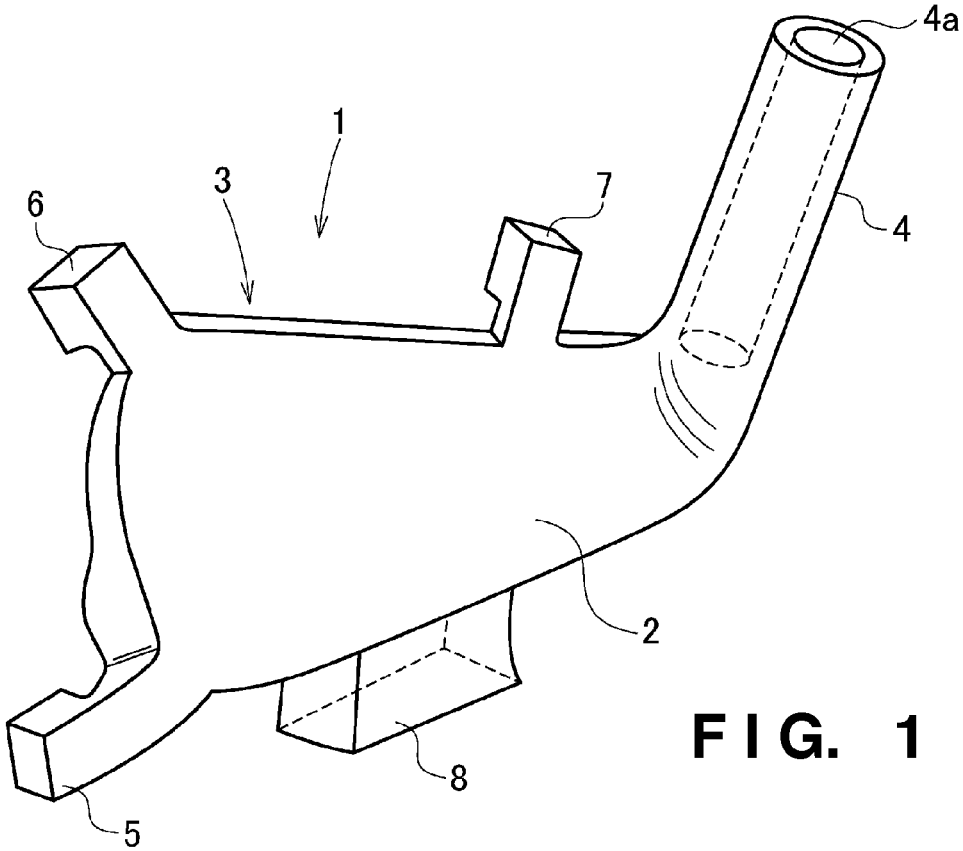
FIG. 1 is a perspective view when viewed from the front side, which shows a method of manufacturing an iron type golf club head according to an embodiment of the present invention.

An embodiment will be described below with reference to FIGS. 1 to 5.

In this embodiment, a head base body is prepared first. Examples of the method of manufacturing this head base body include casting, forging, and machining. Although head base bodies manufactured by all of these manufacturing methods are applicable to the present invention, a head base body manufactured by casting is adopted in this embodiment.

That is, a head base body 1 is cast first in this embodiment. However, a cast head base body 1 may be purchased. The cast head base body 1 has a main body portion 3 having its front surface serving as a face base surface 2, and a hosel 4 integrally connected to the main body portion 3. A hosel hole 4*a* is formed in the hosel 4. Projecting portions 5, 6, 7, and 8 project from the peripheral edge of the main body portion 3 so as to radially extend nearly parallel to the face base surface 2.

In this embodiment, the projecting portion 5 projects nearly obliquely downward from the toe-side lower portion, the projecting portion 6 projects nearly obliquely upward from the toe-side upper portion, the projecting portion 7 projects nearly upward from the heel side of the upper edge, and the projecting portion 8 projects downward from the sole portion. The projecting portion 8 is a sprue (a substance that has solidified in the sprue portion of a mold) in casting the head base body 1.

In this embodiment, the projecting portions 5, 6, 7, and 8 are made of the same material as the head base body 1, and integrated with the head base body 1. The head base body 1 integrated with the projecting portions 5 to 8 can be manufactured using a cast including a cavity conforming to the head base body 1, and those (sprue portions) conforming to the projecting portions 5 to 8. In this manner, when the main body portion and the projecting portions are made of the same material, they can be integrally manufactured using, for example, a die or mold. In this case, therefore, a head base body provided with projecting portions is easy to manufacture. However, the projecting portions 5 to 8 may be manufactured separately from the head base body 1, and bonded to the head base body 1 by, for example, welding or an adhesive.

Each of the projecting portions 5 to 7 has a thickness which is small on the proximal side and large on the distal side. This is to facilitate cutting of the proximal side. In this embodiment, the front surfaces of the projecting portions 5 to 7 are flush with the face base surface 2. However, the front surfaces of the projecting portions 5 to 7 may sink from the face base surface 2.

The front side of the projecting portion 8 slightly sinks from the face base surface 2.

The lower half of the main body portion 3 has a thickness that increases toward the sole side. The upper half of the main body portion 3 has a flat plate shape with a nearly uniform thickness, but may have a thickness that gradually decreases toward the upper edge.

Figure 2:
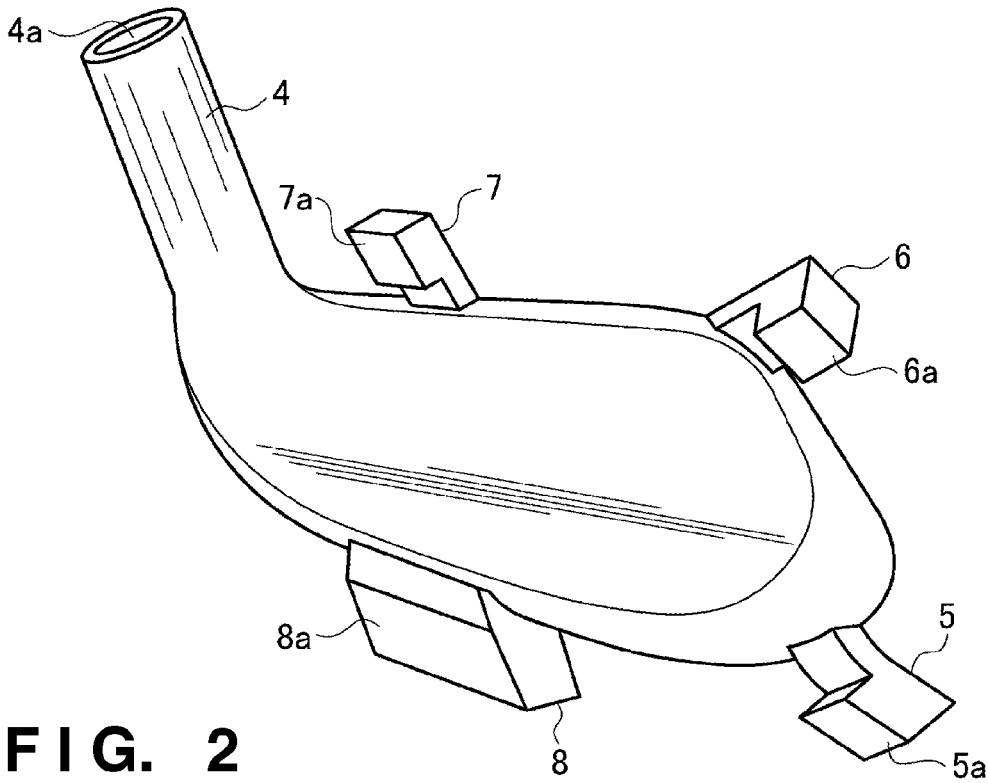
FIG. 2 is a perspective view when viewed from the back side, which shows the method of manufacturing an iron type golf club head according to the embodiment.

To finish the head base body 1, first, the lower surfaces of the projecting portions 5 to 8 are cut so as to be parallel to the face base surface 2, thereby forming parallel surfaces 5*a* to 8*a* (FIG. 2). In this operation, the lower surfaces of the projecting portions 5 to 8 are preferably cut while the upper half of the main body portion 3 is fixed in position upon being clamped from both its upper and lower surfaces, but the present invention is not limited to this.

Figure 3:
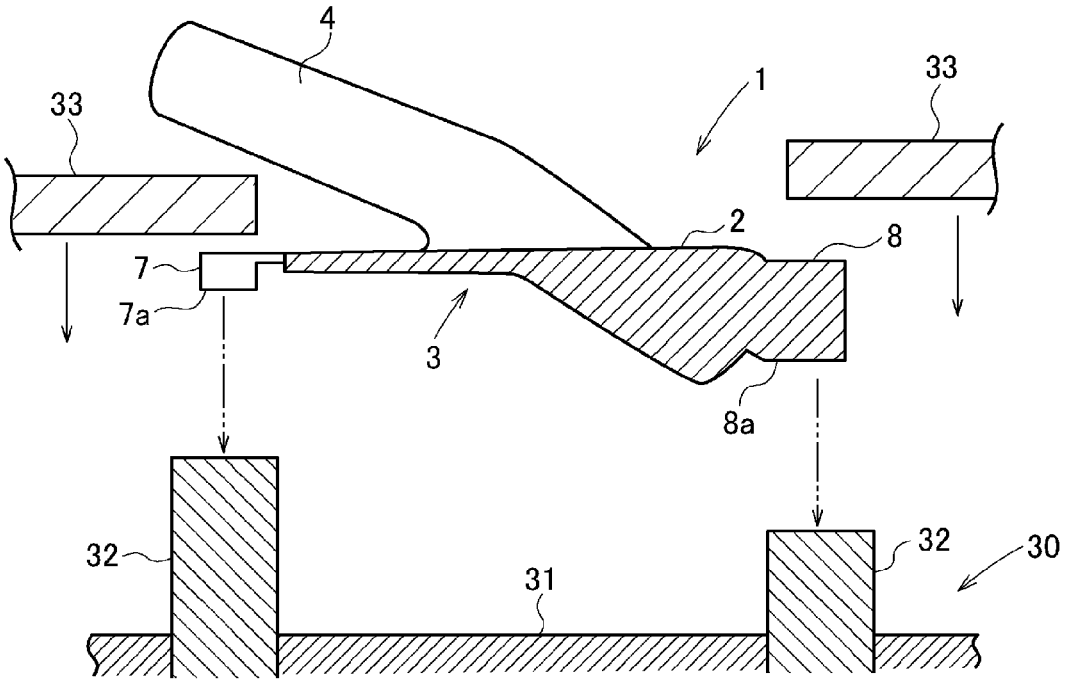
FIG. 3 is a sectional view showing the method of manufacturing an iron type golf club head according to the embodiment.

Next, the head base body 1 is mounted onto a support device 30 such that the face base surface 2 of the head base body 1 is horizontally oriented, as shown in FIG. 3. The support device 30 includes, for example, a main base 31, a plurality of sub-bases 32 projecting upward from the main base 31, and a plate-like member 33 for pressing, from above, the projecting portions 5 to 8, placed on the sub-bases 32, respectively. The arrangement of the sub-bases 32 is the same as that of the projecting portions 5 to 8.

The head base body 1 is disposed such that the face base surface 2 faces up and the projecting portions 5 to 8 are provided with the sub-bases 32 in one-to-one correspondence. After that, the projecting portions 5 to 8 are pressed from above by the plate-like member 33, thereby fixing the head base body 1 in position.

The sub-bases 32 may have levels that can be adjusted with respect to the main base 31 so that the levels of the sub-bases 32 are adjusted in accordance with the product number of an iron head. Alternatively, the sub-base 32 or the entire support device 30 may be exchanged with another one in accordance with the product number of an iron head.

In this manner, after the head base body 1 is fixed onto the support device 30, the face base surface 2 is ground, and scorelines 21 (FIG. 4) are formed in the face base surface 2 by cutting. The face base surface 2 may be milled as needed. This milling is preferably performed before the scorelines 21 are formed. Also, a design may be drawn on the face base surface 2 to form punch marks on it or a three-dimensional pattern may be formed on the face base surface 2 as needed.

Figure 4:
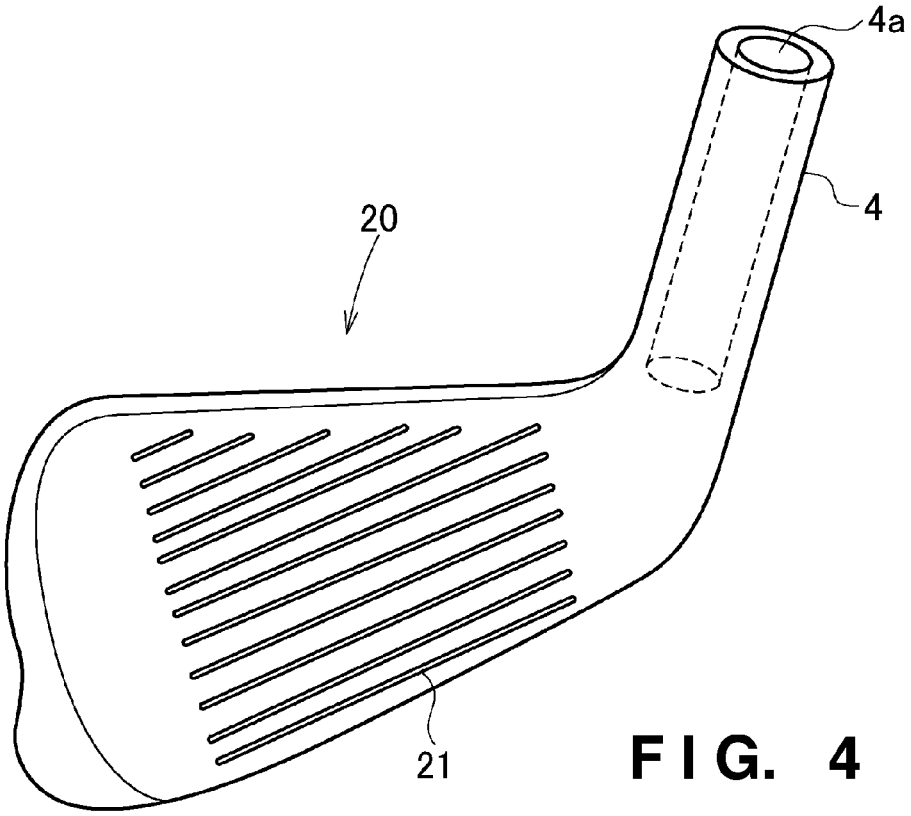
FIG. 4 is a perspective view of the manufactured iron head.
Figure 5:
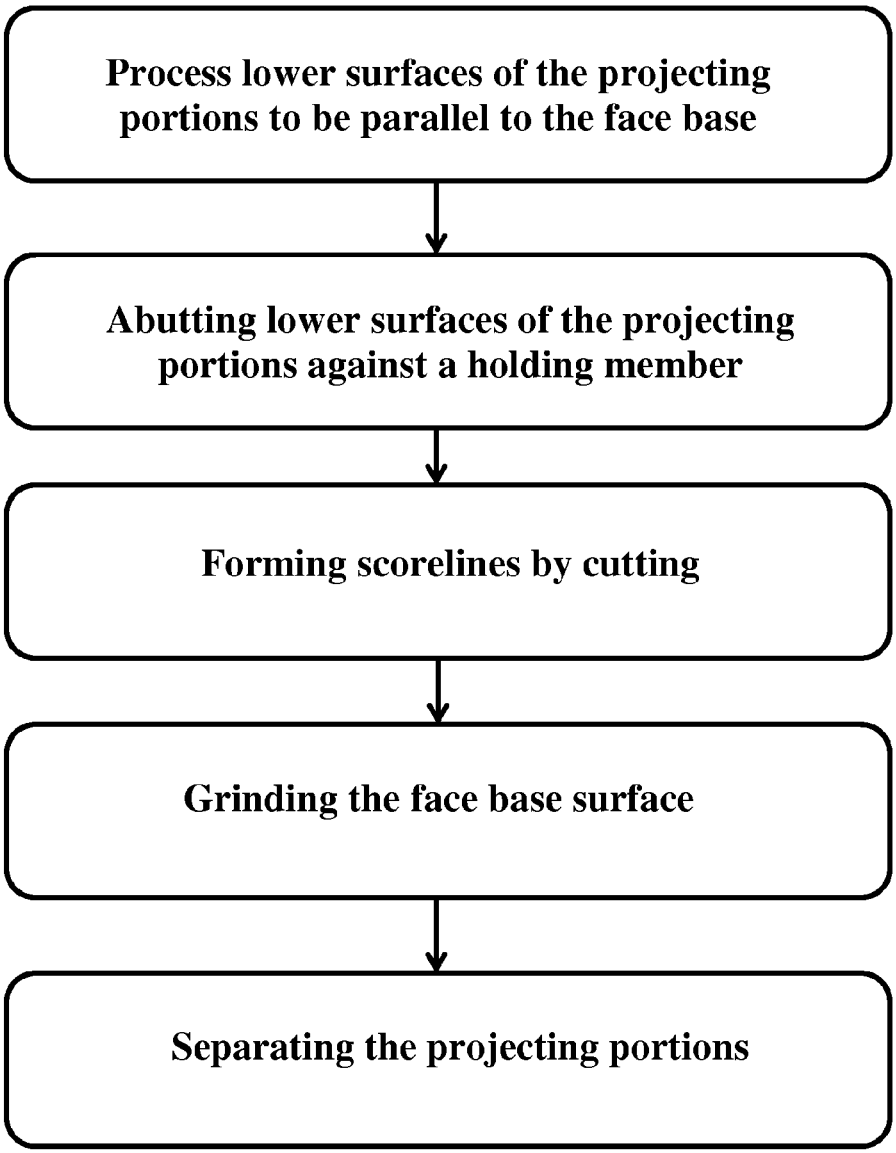
FIG. 5 is a block diagram of a manufacturing process for a golf club head in accord with an embodiment.

After that, the head base body 1 with its face processed is removed from the support device 30, the projecting portions 5 to 8 are cut, and the cut surfaces are ground and polished, thereby producing an iron head 20 (FIG. 4). In cutting the projecting portions 5 to 8, the head base body 1 may be clamped using a jig or held down by the operator with his or her hand. Alternatively, the projecting portions 5 to 8 may be cut while being fixed on the support device 30. In this manner, when the projecting portions are separated after the head base body is finished, they are preferably cut and removed.

In this manner, in this embodiment, the projecting portions 5 to 8 are provided on the head base body 1 and fixed in position by the support device 30, and the face base surface 2 is ground and scorelines are formed in it. Hence, the face base surface 2 can be easily, efficiently processed with high accuracy without causing the head base body 1 to oscillate during the processing of the face base surface 2.

Examples of head base body finishing include grinding, milling, and scoreline formation by cutting. Note that the head base body often oscillates especially during scoreline formation by cutting. In this case, the head base body can be efficiently processed with high accuracy upon being tightly fixed in position.

The head base body can be tightly held/fixed in position upon providing projecting portions to extend in a plurality of directions, and especially, three or more directions.

Moreover, since the lower surfaces of the projecting portions 5 to 8 are parallel to the face surface, the face surface can be placed parallel to the support device 30. In this case, the head base body is processed perpendicularly to the support device 30, and therefore can be processed with high accuracy. When the projecting portions are positioned so their front surfaces are flush with the face base surface or sink from it, they do not hinder finishing of the face base surface.

In this embodiment, a sprue is used for the projecting portion 8, and the three, projecting portions 5, 6, and 7 need only be formed separately. In this case, the head manufacturing cost can be reduced because of, for example, both saving of the amount of material and separation by cutting of the projecting portions and the sprue. In this manner, when the head base body is a cast product, a sprue is formed integrally with the head base body. Hence, the sprue can be effectively utilized by using it as the projecting portion. Also, decreasing the number of projecting portions to be separately formed can reduce the manufacturing cost of a golf club head.

In this embodiment, the projecting portions 5 to 8 radially project to be nearly flush with the face base surface 2. Hence, the projecting portions 5 to 8 can be easily fixed onto the support device 30, and the fixing state can be easily checked by visual observation.

In this embodiment, the projecting portions 5 to 8 radially project in four directions when viewed from the front side of the face. Hence, the head base body 1 can be tightly fixed onto the support device 30.

In this embodiment, the parallel surfaces 5*a* to 8*a* that are parallel to the face base surface 2 are formed on the lower surfaces of the projecting portions 5 to 8. This facilitates an operation of mounting the face base surface 2 onto the support device 30 such that the face base surface 2 is oriented parallel to a specific direction such as the horizontal direction. In this manner, when the lower surfaces of the projecting portions are processed to be parallel to the face base surface and abutted against a head base body holding member, the face base surface can be oriented in a predetermined direction.

The above-mentioned embodiment is merely an example of the present invention, and the present invention may be practiced in forms other than that shown in the drawings. For example, three or five or more projecting portions may be used. Nevertheless, three or four projecting portions are preferable, as in the above-mentioned embodiment.

A method of fixing the projecting portions 5 to 8 onto the sub-bases 32 is not limited to that in the above-mentioned embodiment. For example, the head base body may be mounted onto the support device by providing internal threaded holes in the projecting portions 5 to 8, providing bolts on the sub-bases 32 so as to project upward from the upper surfaces of the sub-bases 32 in FIG. 3, and threadably engaging the bolts with the internal threaded holes.

Also, the projecting portions may be large projecting portions with dimensions in the circumferential direction of the main body portion 3, which are longer than those shown in the drawings. That is, for example, one large projecting portion may be provided on the head base body 1 shown in FIGS. 1 and 2 so as to extend from the position of the projecting portion 6 to that of the projecting portion 7 in the circumferential direction of the main body portion 3, in place of the projecting portions 6 and 7. Similarly, one large projecting portion may be provided on the head base body 1 shown in FIGS. 1 and 2 so as to extend from the position of the projecting portion 5 to that of the projecting portion 8 in the circumferential direction of the main body portion 3, in place of the projecting portions 5 and 8. Alternatively, a flange-like projecting portion may be provided to surround almost the entire main body portion 3. Nevertheless, small projecting portions, as in the above-mentioned embodiment (FIGS. 1 and 2) are more preferable than large projecting portions in consideration of their material cost and their separation (for example, cutting) after finishing.

Although the projecting portions 5 to 8 are provided in the peripheral edge of the face blank in the above-mentioned embodiment, they may be provided in other portions. For example, the projecting portions 5 to 8 may be provided on the back surface of the head base body (its surface opposite to the face base surface 2).

Also, although an example in which the present invention is applied to an iron type golf club head has been explained in the above-mentioned embodiment, the present invention is also applicable to golf club heads of other types such as a putter head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-289180, filed Dec. 21, 2009, which is hereby incorporated by reference herein in its entirety.

What is claimed is:

1. A method of manufacturing a golf club head by processing a head base body having a face base surface which becomes a face surface by finishing, wherein the head base body includes a main body portion having the face base surface, and projecting portions which project from the main body portion, and the method comprises:

a finishing step of performing the finishing while the head base body is fixed in position by supporting the projecting portions; and a separation step of separating the projecting portions after the finishing, wherein the finishing step includes:

processing lower surfaces of the projecting portions so as to be parallel to the face base surface;

abutting the lower surfaces of the projecting portions against a holding member to fix the head base body in position;

forming scorelines by cutting; and grinding the face base surface.

2. The method according to claim 1, wherein the finishing includes milling.

3. The method according to claim 1, wherein the projecting portions project in a plurality of directions.

4. The method according to claim 3, wherein the projecting portions project in at least three directions.

5. The method according to claim 1, wherein the main body portion and the projecting portions are made of an identical material.

6. The method according to claim 1, wherein the head base body includes a cast product, and some of the projecting portions include sprues.

7. The method according to claim 1, wherein front surfaces of the projecting portions are flush with the face base surface or sink from the face base surface.

8. The method according to claim 1, wherein in the separation step, the projecting portions are separated by cutting bases of the projecting portions.

9. The method according to claim 1, wherein the projecting portions include a projecting portion having a thickness which is small on a proximal side adjacent the face base surface and large on a distal side distant from the face base surface.

10. A golf club head base body having a face base surface which becomes a face surface by finishing, comprising:

a main body portion having the face base surface; and projecting portions which project from said main body portion and are supported by a finishing device in the finishing, wherein the finishing includes:

processing lower surfaces of the projection portions so as to be parallel to the face base surface;

abutting the lower surfaces of the projecting portions against a holding member to fix the head base body in position;

forming scorelines by cutting;

grinding the face base surface; and wherein the projecting portions include a projecting portion having a thickness which is small on a proximal side adjacent the face base surface and large on a distal side distant from the face base surface.

11. The golf club head base body according to claim 10, wherein said projecting portions project in a plurality of directions from said main body portion.

12. The golf club head base body according to claim 11, wherein said projecting portions project in at least three directions from said main body portion.

13. The golf club head base body according to claim 10, wherein said main body portion and said projecting portions are made of an identical material.

14. The golf club head base body according to claim 10, wherein said head base body includes a cast product, and some of said projecting portions include sprues.

15. The golf club head base body according to claim 10, wherein front surfaces of said projecting portions are flush with the face base surface or sink from the face base surface.

* * * * *